United States Patent [19]

Ikenoue et al.

[11] Patent Number: 4,607,004

[45] Date of Patent: Aug. 19, 1986

[54] SILVER HALIDE COLOR PHOTOGRAPHIC LIGHT-SENSITIVE MATERIAL

[75] Inventors: Shinpei Ikenoue; Haruhiko Iwano; Hiroyuki Mifune; Morio Yagihara, all of Kanagawa, Japan

[73] Assignee: Fuji Photo Film Co., Ltd., Kanagawa, Japan

[21] Appl. No.: 682,452

[22] Filed: Dec. 17, 1984

[30] Foreign Application Priority Data

Dec. 26, 1983 [JP] Japan ..... 58-251821

[51] Int. Cl.[4] ..... G03C 1/34

[52] U.S. Cl. ..... 430/523; 430/611; 430/600; 430/567; 430/551; 430/505; 430/503; 430/961; 430/622

[58] Field of Search ..... 430/611, 600, 567, 551, 430/505, 961, 503, 622, 523

[56] References Cited

U.S. PATENT DOCUMENTS

| | | | |
|---|---|---|---|
| 4,021,248 | 5/1977 | Shiba et al. | 430/551 |
| 4,328,302 | 5/1982 | Nishimura et al. | 430/611 |
| 4,418,140 | 11/1983 | Mifune et al. | 430/551 |
| 4,448,878 | 5/1984 | Yamamuro et al. | 430/551 |

*Primary Examiner*—Won H. Louie

*Attorney, Agent, or Firm*—Sughrue, Mion, Zinn, Macpeak, and Seas

[57] ABSTRACT

A silver halide color photographic light-sensitive material is disclosed, comprising a support having provided thereon light-sensitive silver halide emulsion layers, wherein on the outside of the light-sensitive silver halide emulsion layer positioned farthest from the support, a layer containing silver halide fine grains of about 0.2$\mu$ or less in average grain size is provided, and in the silver halide color photographic light-sensitive material at least one compound represented by the following general formula (I) is present:

(I)

wherein M represents a hydrogen atom, an alkali metal or a quaternary ammonium group, X represents COOM′ or $SO_3M'$ (wherein M′ represents a hydrogen atom, an alkali metal or a quaternary ammonium group), n represents 1 or 2, $R_1$ represents a group capable of substituting on the phenyl group, and m represents 0, 1 or 2.

15 Claims, No Drawings

SILVER HALIDE COLOR PHOTOGRAPHIC LIGHT-SENSITIVE MATERIAL

FIELD OF THE INVENTION

The present invention relates to silver halide color photographic light-sensitive materials which have excellent processability, undergo less fog, and show excellent preservability of unexposed light-sensitive materials (shelf preservability).

BACKGROUND OF THE INVENTION

In recent years, silver halide color photographic light-sensitive materials have been subjected to high temperature, accelerated processing for conducting rapid processing. Also, preparation of large size silver halide grains, enhancement of activity of the color couplers used, and addition of development accelerators or development accelerator-releasing compounds to light-sensitive materials have been employed for enhancing the sensitivity of the light-sensitive materials.

However, these techniques cause serious problems such as an increased fog of the silver halide color light-sensitive materials or more increased fog after preservation of them as unexposed materials.

In addition, hardeners having an active vinyl group, which have come into wide use for accelerating the progress of hardening after silver halide emulsions are coated on a support, cause an increased fog in comparison with triazine type hardeners, and the fog is more increased after preservation of the unexposed light-sensitive materials.

As one technique to solve the problem of fogging, it has been known to add various antifoggants for preventing fogging of silver halide color photographic light-sensitive materials and increased fogging after preservation of the light-sensitive materials as unexposed light-sensitive materials.

That is, many compounds such as azoles [e.g., benzothiazolium salts, nitroindazoles, triazoles, benzotriazoles, benzimidazoles (particularly nitro- or halogen-substituted benzimidazoles)]; heterocyclic mercapto compounds [e.g., mercaptothiazoles, mercaptobenzothiazoles, mercaptobenzimidazoles, mercaptothiadiazoles, mercaptotetrazoles (particularly 1-phenyl-5-mercaptotetrazole), mercaptopyrimidines, etc.]; thioketo compounds (e.g., oxazolinethione); azaindenes [e.g., tetraazaindenes (particularly 4-hydroxy-substituted (1,3,3a,7)tetraazaindenes, etc.)]; benzenethiosulfonic acids; benzenesulfinic acids; etc., known as antifoggants or stabilizers can be added.

As to more specific examples thereof and manners of their use, reference may be made to, for example, U.S. Pat. Nos. 3,954,474, 3,982,947, 4,021,248, etc., or Japanese Patent Publication No. 28660/77.

However, application of the above-described antifoggants to color photographic light-sensitive materials cause various side effects, which impose restrictions on the amounts of them to be added. Thus, sufficient antifogging effects cannot be attained.

U.S. Pat. No. 3,376,310, for example, discloses a technique of using phenylmercaptotetrazoles with a diffusion-preventing ballast group to provide the antifogging effect of the compounds selectively on a specific layer. The antifoggants inhibit development so much that direct addition of the antifoggants to light-sensitive materials is not preferable because it causes reduction of sensitivity and deterioration of gradation. Furthermore, Japanese Patent Publication No. 9939/83 (corresponding to U.S. Pat. No. 4,021,248), for example, discloses that heterocyclic mercapto groups having at least one group selected from —$SO_3H$, —COOH, —OH or —$NH_2$ can depress fog without serious deterioration of sensitivity and gradation. Of the compounds disclosed therein, phenylmercaptotetrazoles having —COOH or —$SO_3H$ are found to cause an extremely slight reduction of sensitivity and deterioration of gradation and depress fogging of light-sensitive materials and increased fogging after preservation of unexposed light-sensitive materials. However, the compounds have problems in that they dissolve into a developer and thus change the properties of the developer. Further, when light-sensitive materials containing the compounds are developed with a developer having its activity reduced by a development-inhibiting substance dissolved therein, the light-sensitive materials suffer more reduction of sensitivity or more deterioration of gradation as compared with the other light-sensitive materials.

SUMMARY OF THE INVENTION

An object of the present invention is to provide a silver halide color photographic light-sensitive material which scarcely contaminates a developer, which forms less fog, and which possesses a good shelf preservability.

Another object of the present invention is to provide a silver halide color photographic light-sensitive material which undergoes less deterioration of its photographic properties when developed with a developer which has been contaminated and suffered a reduction of its developing ability, which forms less fog and which has an excellent shelf preservability.

These and other objects of the present invention will become apparent from the following description thereof.

As a result of various investigations, the inventors have found that the above-described and other objects of the present invention are attained by a silver halide color photographic light-sensitive material comprising a support having provided thereon light-sensitive silver halide emulsion layers, wherein, on the outside of the light-sensitive silver halide emulsion layer positioned farthest from the support, a layer containing silver halide fine grains of 0.2$\mu$ or less in average grain size is provided, and in the silver halide color photographic light-sensitive material at least one compound represented by the general formula (I) set forth below is present.

DETAILED DESCRIPTION OF THE INVENTION

The phenylmercaptotetrazoles to be used in the present invention which have a water-soluble group, such as $SO_3M'$ or COOM' (particularly preferably COOM'), capable of conferring solubility to an antifoggant at a pH condition of a developer can effectively depress fogging of light-sensitive materials and can prevent an increase in fog caused after preservation of unexposed light-sensitive materials without serious reduction of sensitivity and serious deterioration of gradation of the light-sensitive materials because the compounds have the good balance between fog-depressing ability and solubility in a developer.

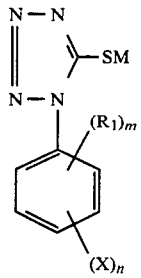

(I)

In the above general formula (I), M represents a hydrogen atom, an alkali metal atom or a quaternary ammonium group, X represents COOM′ or $SO_3M'$ (wherein M′ represents a hydrogen atom, an alkali metal atom or a quaternary ammonium group), n represents 1 or 2, $R_1$ represents a group capable of substituting on the phenyl group, and m represents 0, 1 or 2, provided that, when m=2, the two $R_1$'s may be the same or different.

In the above general formula (I), the alkali metal atom is specifically exemplified by sodium, potassium, lithium, etc., and the quaternary ammonium group is exemplified by $-\overset{\oplus}{N}H_4$, $-\overset{\oplus}{N}(CH_3)_4$, $-\overset{\oplus}{N}(C_2H_5)_4$, $-\overset{\oplus}{N}H(C_2H_5)_3$, etc.

X particularly preferably represents —COOM′.

Specific examples of $R_1$ in the general formula (I) include a halogen atom (e.g., a fluorine atom, a chlorine atom, a bromine atom, etc.), an alkyl group (e.g., a methyl group, an ethyl group, a hydroxyethyl group, a benzyl group, a β-dimethylaminoethyl group, etc.), an aryl group (e.g., a phenyl group), an alkoxy group (e.g., a methoxy group, an ethoxy group, etc.), an aryloxy group (e.g., a phenyloxy group, etc.), an alkoxycarbonyl group (e.g., a methoxycarbonyl group, etc.), an acylamino group (e.g., an acetylamino group, a methoxymethylcarbonylamino group, etc.), a carbamoyl group, an alkylcarbamoyl group (e.g., a methylcarbamoyl group, an ethylcarbamoyl group, etc.), a dialkylcarbamoyl group (e.g., a dimethylcarbamoyl group, etc.), an arylcarbamoyl group (e.g., a phenylcarbamoyl group, etc.), an alkylsulfonyl group (e.g., a methylsulfonyl group, etc.), an arylsulfonyl group (e.g., a phenylsulfonyl group, etc.), an alkylsulfonamido group (e.g., a methanesulfonamido group, etc.), an arylsulfonamido group (e.g., a phenylsulfonamido group, etc.), a sulfamoyl group, an alkylsulfamoyl group (e.g., an ethylsulfamoyl group, etc.), a dialkylsulfamoyl group (e.g., a dimethylsulfamoyl group, etc.), an alkylthio group (e.g., a methylthio group, etc.), an arylthio group (e.g., a phenylthio group, etc.), a cyano group, a nitro group, a hydroxy group, an amino group, etc. When two $R_1$'s are present, they may be the same as or different from each other.

Particularly preferable examples of $R_1$ include an alkyl group, a substituted alkyl group, an alkoxy group, and a substituted alkoxy group, having up to 3 carbon atoms.

Specific examples of the compounds are illustrated below.

(1)

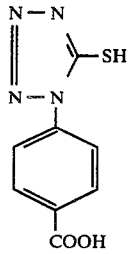

(2)

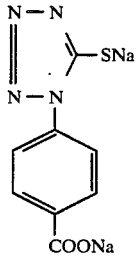

(3)

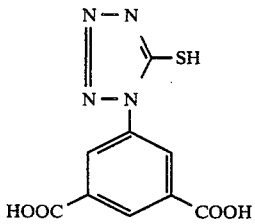

(4)

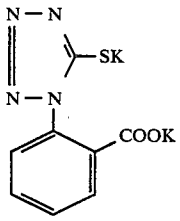

(5)

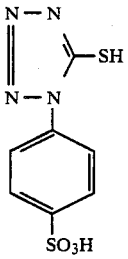

(6)

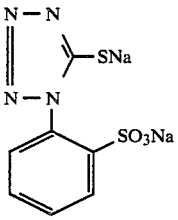

-continued (7)

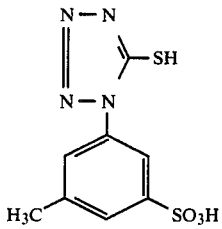

(8)

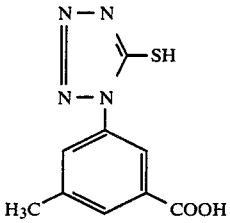

(9)

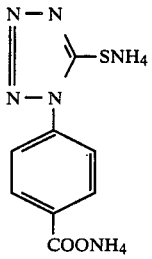

(10)

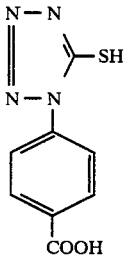

(11)

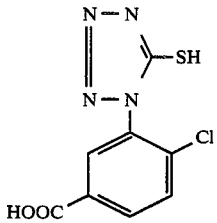

(12)

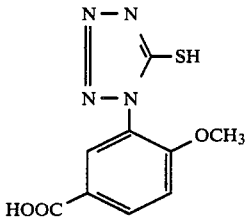

-continued (13)

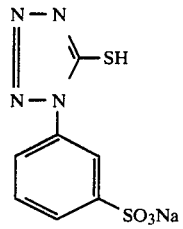

(14)

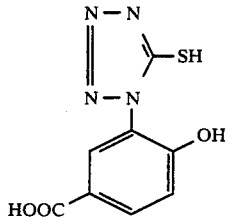

(15)

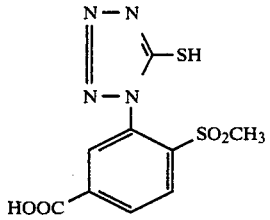

The compounds represented by the general formula (I) are added preferabin in amounts of about $10^{-4}$ to about $10^{-1}$ mol, more preferably $10^{-3}$ mol to $5\times10^{-2}$ mol, per mol of silver.

The compounds of the general formula (I) may be directly added to a light-sensitive emulsion layer or to a protective layer or an interlayer (e.g., a yellow filter layer) to obtain sufficient effects of the present invention.

Preferably, the compounds of the general formula (I) are incorporated in the layer that contains fine silver halide grains or in a layer positioned closer to the support than the above-described layer, with the latter being particularly preferable.

The compounds of the general formula (I) are added generally to a coating solution as an aqueous or alcohol solution, but other various known techniques may be employed to add the compounds.

In the case of directly adding the compound of the general formula (I) to a light-sensitive emulsion layer containing a sensitizing dye, the compound of the general formula (I) is preferably added after addition of the sensitizing dye.

The fine grain silver halide emulsion layer to be used in the present invention is provided for the purpose of compensating for the defect of compound (I) of the present invention such as ease of dissolution into a developer and, at the same time, preventing a development inhibitor in a developer from entering into the light-sensitive layers to too strongly inhibit development together with compound (I) of the present invention thereby to reduce sensitivity and deteriorate gradation. Therefore, the fine grain silver halide emulsion layer is particularly preferably provided on the light-sensitive silver halide emulsion layer positioned farthest from the support.

The silver halide fine grains to be used in the present invention for the above-described purpose are preferably not substantially developable by development processing of the silver halide color photographic light-sensitive material. In addition, the above-described silver halide fine grains are preferably comparatively light-insensitive. The term "comparatively light-insensitive" as used herein preferably means to be less sensitive than light-sensitive silver halide grains by 0.5 or more, more preferably 1.0 or more, in terms of log units.

The silver halide fine grains of the present invention may be any of pure silver chloride, pure silver bromide, pure silver iodide, silver chlorobromide, silver bromoiodide, and silver chlorobromoiodide, with grains containing 60 mol% or more silver bromide, up to 30 mol% silver chloride, and up to 40 mol% silver iodide being preferable. In particular, silver bromoiodide grains containing up to 10 mol% silver iodide are preferable. The average grain size is up to 0.2 μm, preferably up to 0.15 μm, more preferably up to 0.1 μm.

The silver halide fine grains to be used in the present invention may have a comparatively broad grain size distribution. However, grains with a narrow grain size distribution are preferable. In particular, silver halide grains 90% by weight or on a number basis of which have grain sizes within ±40% of the average grain size are preferable.

The silver halide fine grains are coated in amounts of 0.03 to 2 g of silver/$m^2$, preferably 0.05 to 1 g/$m^2$. As the binder for the layer containing silver halide fine grains, any hydrophilic polymer can be used, with hydrophilic colloids being more preferable, with gelatin being particularly preferable. For example, proteins such as gelatin derivatives, graft polymers between gelatin and other polymer, albumin, casein, etc.; cellulose derivatives such as hydroxyethyl cellulose, carboxymethyl cellulose, cellulose sulfate, etc.; sugar derivatives such as sodium alginate, starch derivatives; etc.; and various synthetic hydrophilic polymeric substances such as homopolymers or copolymers (e.g., polyvinyl alcohol, partially acetalized polyvinyl alcohol, poly-N-vinylpyrrolidone, polyacrylic acid, polymethacrylic acid, polyacrylamide, polyvinyl imidazole, polyvinyl pyrazole, etc.) can be used as hydrophilic colloids. The amount of binder is preferably less than 400 g/mol of silver, more preferably less than 250 g/mol of silver.

The silver halide fine grains can be prepared according to known processes. That is, any of an acid process, a neutral process, and an ammonia process can be used. As a manner of reacting a soluble silver salt with a soluble halide salt, any of single jet process, double jet process, and their combination may be employed. As one type of the double jet process, a process called a controlled double jet process wherein the pAg in a liquid phase in which silver halide is formed is kept constant can be employed. The controlled double jet process is preferably used, when preparing the fine grain silver halide emulsion to be used in the present invention, because the grain size distribution of the emulsion prepared with the process is narrow. The silver halide fine grains may have a regular form such as cubic form, octahedral form, dodecahedral form or tetradecahedral form, or may have an irregular form such as spherical form or tabular form. The interior and the surface layer of the silver halide grains may be different in halide composition, or may be uniform throughout. The comparatively light-insensitive emulsion may contain cadmium ion, lead ion, iridium ion, rhodium ion, etc., as impurities. The silver halide fine grain emulsion may be of surface latent image-forming type or internal latent image-forming type, and may contain fogging nuclei in the interior thereof.

The fine grain silver halide emulsion of the present invention may be subjected to usual chemical sensitization, i.e., sulfur sensitization, gold sensitization or reduction sensitization, but emulsions not subjected to the chemical sensitization (called primitive emulsions) are preferable in the present invention.

The fine grain silver halide emulsion may contain an antifoggant or a stabilizer. For example, such antifoggants or stabilizers as azoles, heterocyclic mercapto compounds, thioketo compounds, azaindenes, benzenethiosulfonic acids, benzenesulfinic acids, etc., may be added to the emulsion. The details thereof are hereinafter given.

The fine grain silver halide emulsion layer may contain a coupler or couplers. The details thereof are hereinafter given.

Dyes or UV ray absorbents may be added to the fine grain silver halide emulsion layer of the present invention. They may be mordanted with a cationic polymer. The details thereof are hereinafter given.

The fine grain emulsion layer may contain a dispersion of water-insoluble or slightly water-soluble synthetic polymer for the purpose of improving dimensional stability or the like. The details thereof are hereinafter given.

The fine grain emulsion layer of the present invention may contain an inorganic or organic hardener. The details thereof are hereinafter given.

The fine grain emulsion layer of the present invention may contain a surfactant or surfactants for various purposes, e.g., as a coating aid, for preventing the generation of static charges, improving slip characteristics, improving emulsification and dispersion, preventing adhesion, improving photographic characteristics (e.g., accelerating development, increasing contrast and sensitization), etc. The details thereof are hereinafter given.

As a binder or protective colloid for emulsion layers or hydrophilic colloidal layers (e.g., protective layer, interlayer, etc.) of the light-sensitive material of the present invention, gelatin is advantageously used. However, other hydrophilic colloids as described above can be used as well.

As gelatin, acid-processed gelatin or enzyme-processed gelatin as described in *Bull. Soc. Sci. Phot. Japan,* No. 16, p. 30 (1966) may be used as well as lime-processed gelatin, and a gelatin hydrolyzate or an enzyme-decomposed product can be used.

In a photographic emulsion layer of the photographic light-sensitive material of the present invention, any of silver bromide, silver bromoiodide, silver chlorobromoiodide, silver chlorobromide, and silver chloride may be used as a light-sensitive silver halide. A preferable silver halide is silver bromoiodide which contains up to 15 mol%, particularly preferably 2 mol% to 12 mol%, silver iodide.

Silver halide grains in the photographic emulsion are not particularly limited as to mean grain size (grain diameter with respect to spherical or approximately spherical grains, and edge length with respect to cubic grains; presented in terms of an average based on projected area), with a grain size of 3μ or less being preferable. The grain size distribution can be either narrow or broad.

Silver halide grains may be in a regular crystal form such as cubic, octahedral or tetradecahedral form, in an irregular form such as spherical or tabular form, or in a mixed form thereof, or may comprise a mixture of grains in different forms.

In addition, emulsions in which super-tabular silver halide grains of 5 or more in diameter-to-thickness ratio account for 50% or more of the total grains based on the projected area of the grains may also be used. Detailed descriptions thereon are described in Japanese Patent Application (OPI) Nos. 127921/83 and 113927/83 (corresponding to U.S. Pat. Nos. 4,434,226 and 4,433,048) (the term "OPI" as used herein refers to a "published unexamined Japanese patent application").

The silver halide grains may have an inner portion and a surface layer different from each other in phase composition. In addition, silver halide grains of the type forming a latent image mainly on the surface thereof and grains of the type forming a latent image mainly within them may be used.

The photographic emulsion to be used in the present invention can be prepared by the processes described in P. Glafkides, *Chimie et Physique Photographique* (published by Paul Montel Co. in 1967), G. F. Duffin, *Photographic Emulsion Chemistry* (The Focal Press, 1966), V. L. Zelikman et al., *Making and Coating Photographic Emulsion* (The Focal Press, 1964), etc. That is, any of an acid process, a neutral process, and an ammonia process can be used. As a manner of reacting a soluble silver salt with a soluble halide salt, any of single jet process, double jet process and their combination may be employed.

A process of forming grains in the presence of excess silver ion (called reverse mixing process) can be employed as well. As one type of the double jet process, a process called controlled double jet process wherein the pAg in a liquid phase in which silver halide is formed is kept constant can be employed. This process provides a silver halide emulsion containing silver halide grains having an approximately regular crystal form and an approximately uniform grain size.

Two or more silver halide emulsions having been separately prepared may be mixed to use.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

The silver halide emulsion is usually subjected to chemical sensitization. Chemical sensitization can be conducted according to the processes described in, for example, *Die Gründlagen der Photographischen Prozesse mit Silberhalogeniden,* compiled by H. Frieser (Akademische Verlagsgesellschaft, 1968), pp. 675–734.

That is, sulfur sensitization using active gelatin or sulfur-containing compounds capable of reacting with silver (e.g., thiosulfates, thioureas, mercapto compounds, rhodanines, etc.); reduction sensitization using a reductive substance (e.g., stannous salts, amines, hydrazine derivatives, formamidinesulfinic acid, silane compounds, etc.); and noble metal sensitization using compounds of noble metals (e.g., gold complex salts and complex salts of metals belonging to the group VIII of the Periodic Table such as Pt, Ir, Pd, etc.) can be employed alone or in combination.

To the photographic emulsion to be used in the present invention may be added various compounds for the purpose of preventing formation of fog or stabilizing photographic properties in the steps of producing, or during storage or processing of, light-sensitive materials. That is, many compounds such as azoles [e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.]; mercaptopyrimidines; mercaptotriazines; thioketo compounds such as oxazolinethione; azaindenes [e.g., triazaindenes, tetraazaindenes (particularly, 4-hydroxy-substituted (1,3,3a,7)tetraazaindenes), pentaazaindenes, etc.]; benzenethiosulfonic acid, benzenesulfinic acid, benzenesulfonic acid amide, etc., known as antifoggants or stabilizers can be used.

More specific examples and manner of the use thereof are described in, for example, U.S. Pat. Nos. 3,954,474 and 3,982,947, and Japanese Patent Publication No. 28660/77.

The light-sensitive material of the present invention may contain various known surface active agents for various purposes, e.g., as a coating aid, for preventing the generation of static charges, improving slip characteristics, improving emulsification and dispersion, preventing adhesion, improving photographic characteristics (e.g., accelerating development, increasing contrast and sensitization), etc.

For example, natural surface active agents such as saponin (steroids), nonionic surface active agents such as alkylene oxide derivatives (e.g., polyethylene glycol, polyethylene glycol/polypropylene glycol condensate, polyethylene glycol alkyl ether or polyethylene glycol alkylaryl ethers, polyethylene glycol esters, polyethylene glycol sorbitan esters, polyalkylene glycol alkylamine or amides, silicone polyethylene oxide adducts, etc.), glycidol derivatives (e.g., alkenylsuccinic acid polyglycerides or alkylphenol polyglycerides), aliphatic esters of polyhydric alcohols, alkyl esters of sucrose, etc.; anionic surface active agents containing an acidic group such as a carboxy group, a sulfo group, a sulfuric acid ester group or a phosphoric acid ester group, such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkylphenol ethers or polyoxyethylene alkylphosphates; amphoteric surface active agents such as amino acids, aminoalkylsulfonic acids, aminoalkylsulfuric acid esters, aminoalkyl phosphoric acid esters, alkylbetaines or amine oxides; and cationic surface active agents such as alkylamine salts, aliphatic or aromatic quaternary ammonium salts, hetero ring quaternary ammonium salts (such as pyridinium or imidazolium salts) or phosphonium or sulfonium salts containing an alicyclic or heterocyclic ring can be used.

The light-sensitive material of the present invention may contain a polyalkylene oxide or its ether, ester or amine derivative, a thioether compound, a thiomorpholine, a quaternary ammonium salt compound, a urethane derivative, a urea derivative, an imidazole derivative, a 3-pyrazolidone, etc., for the purpose of enhancing sensitivity or contrast or for accelerating development. For example, those described in U.S. Pat. Nos. 2,400,532, 2,423,549, 2,716,062, 3,617,280, 3,772,021, 3,808,003, British Pat. No. 1,488,991, etc., can be used.

The photographic light-sensitive material to be used in the present invention can contain in its photographic emulsion layer or other hydrophilic colloidal layers a dispersion of a synthetic polymer which is insoluble or slightly soluble in water for the purpose of improving the dimensional stability or other purposes. Examples of polymers which can be used include polymers composed of one or more alkyl acrylates or methacrylates, alkoxyalkyl acrylates or methacrylates, glycidyl acrylates or methacrylates, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylates or methacrylates, sulfoalkyl acrylates or methacrylates, or styrene-sulfonic acid, etc.

The photographic emulsions used in the present invention can be spectrally sensitized with methine or other dyes. Suitable sensitizing dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes and complex merocyanine dyes. These dyes can contain, as a basic heterocyclic nucleus, any of the nuclei which are usually employed in cyanine dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the like; nuclei as described above condensed with an alicyclic hydrocarbon ring; and nuclei as described above condensed with an aromatic hydrocarbon ring, such as indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus may be contained. The carbon atoms of the above-described nuclei may be substituted.

The merocyanine dyes or complex merocyanine dyes can contain, as a nucleus having a ketomethylene structure, a pyrazolin-5-one nucleus, a thiohydantoin nucleus, a 2-thiooxazolidine-2,4-dione nucleus, a thiazolidine-2,4-dione nucleus, a rhodanine nucleus, or a thiobarbituric acid nucleus.

The photographic light-sensitive material of the present invention may contain an organic or inorganic hardener in its photographic emulsion layers or other hydrophilic layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methylol-dimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., can be used alone or in combination.

Of the above-described hardeners, the active vinyl compounds are preferable for accelerating the progress of hardening after the emulsion layers are coated. That is, there are effects such that the use of the fine grain silver halide emulsion and the compound of the general formula (I) of the present invention can effectively depress fogging of unexposed light-sensitive materials or increased fogging after preservation to be caused by the active vinyl compounds, or etc.

As such active vinyl compounds, those described in the following patents may be used: for example, hardeners described in Japanese Patent Application (OPI) Nos. 41221/78 (corresponding to U.S. Pat. No. 4,137,082), 57257/78 (corresponding to U.S. Pat. No. 4,173,481), 126124/76 (corresponding to U.S. Pat. No. 4,028,320), Japanese Patent Publication No. 13563/74, Japanese Patent Application (OPI) Nos. 44164/76 (corresponding to U.S. Pat. No. 4,088,495), 21059/77 (corresponding to U.S. Pat. No. 4,142,897), U.S. Pat. Nos. 3,490,911 and 3,539,644, Japanese Patent Publication No. 35807/75 (corresponding to U.S. Pat. No. 3,868,257), Japanese Patent Application (OPI) Nos. 30022/79 and 66960/78 (corresponding to U.S. Pat. No. 4,134,770), Japanese Patent Publication Nos. 46495/77 and 8736/72 (corresponding to U.S. Pat. No. 3,689,274), U.S. Pat. Nos. 3,635,718 and 3,040,720, and West German Patent No. 872,153 may be used.

Preferable examples of these compounds are those which are represented by the following general formula (II):

$$(CH_2{=}CH{-}SO_2{-}CH_2)_2A \qquad \text{(II)}$$

wherein A represents a divalent group, which may or may not be present.

Examples of the compounds to be used in the present invention are illustrated below:

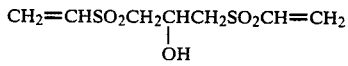

V-1

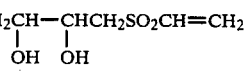

V-2

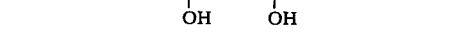

V-3

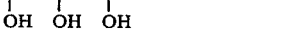

V-4

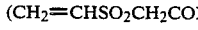

V-5

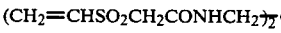

V-6

V-7

V-8

V-9

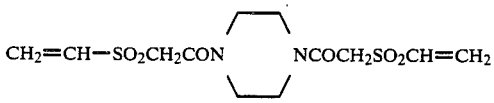

V-10

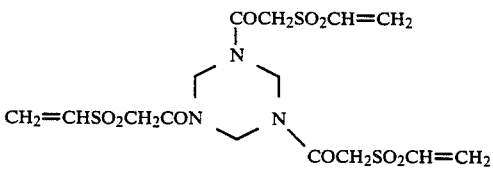

-continued

V-11

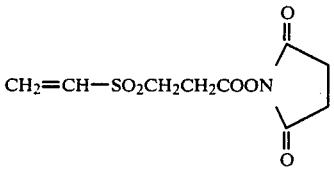

V-12

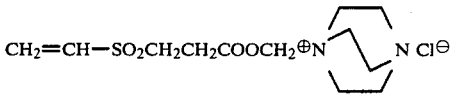

$CH_2{=}CHSO_2CH_2SO_2CH{=}CH_2$ V-13

$CH_2{=}CH{-}SO_2CH_2CH_2SO_2CH{=}CH_2$ V-14

$CH_2{=}CH{-}SO_2CH_2CH_2CH_2SO_2CH{=}CH_2$ V-15

V-16

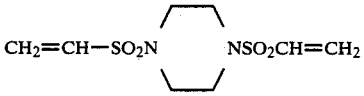

$C_2H_5C(CH_2SO_2CH{=}CH_2)_3$ V-17

$CH_2{=}CHSO_2CH_2CH(SO_2CH{=}CH_2)CH_2SO_2CH{=}CH_2$ V-18

V-19

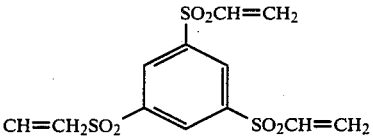

V-20

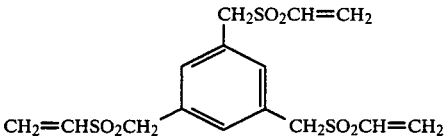

$(CH_2{=}CHSO_2CH_2)_4C$ V-21

$(CH_2{=}CHSO_2CH_2)_3CCH_2SO_2CHCH_2NHCH_2CH_2SO_3Na$ V-22

V-23

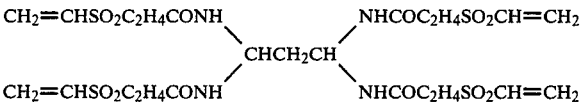

V-24

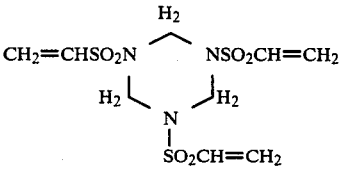

V-25

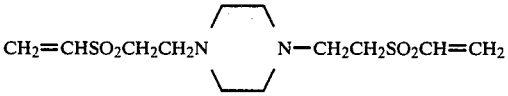

V-26

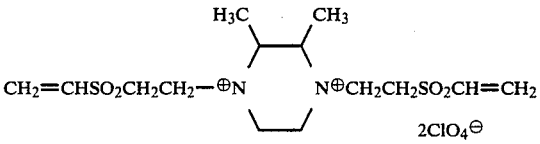

V-27

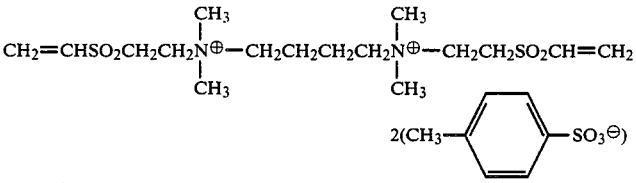

V-28

$CH_2{=}CHSO_2CH_2CH_2SO_2CH_2CH_2SO_2CH{=}CH_2$ $CH_2{=}CHSO_2CH_2CH_2OCH_2CH_2NHCONHCH_2CH_2OCH_2CH_2SO_2CH{=}CH_2$ V-29

$CH_2{=}CHSO_2CH_2CH_2OCH_2CH_2OCH_2CH_2SO_2CH{=}CH_2$ V-30

$CH_2{=}CHSO_2CH_2OCH_2SO_2CH{=}CH_2$ V-31

$CH_2{=}CHSO_2CH_2CH_2OCH_2CH_2SO_2CH{=}CH_2$ V-32

V-33

$CH_2{=}CHSO_2CH_2CH_2CH_2CH_2OCH_2CH_2CH_2CH_2SO_2CH{=}CH_2$ $(CH_2{=}CH{-}SO_2CH_2CH_2CONH)_2CH_2$ V-34

$(CH_2{=}CH{-}SO_2CH_2CH_2CONH{-}CH_2)_2$ V-35

$(CH_2{=}CH{-}SO_2CH_2CH_2CONHCH_2)_2CH_2$ V-36

V-37

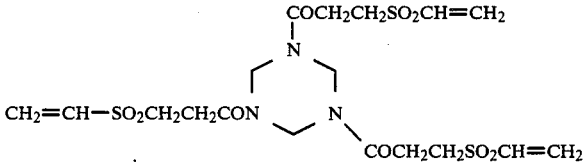

$CH_2{=}CHSO_2CH{=}CH_2$ V-38

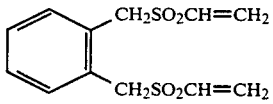

-continued

V-39

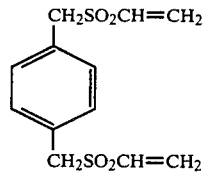

V-40

The amount of the gelatin hardener to be used in the present invention can be optionally selected depending upon the purpose but, usually, it ranges from 0.01 to 20 wt% based on dry gelatin, particularly preferably from 0.1 to 10 wt%.

The present invention may also be applied to a multilayer multicolor photographic material comprising a support having provided thereon at least two layers different from each other in spectral sensitivity. Multilayer natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. The red-sensitive emulsion layer usually contains a cyan-forming coupler, the green-sensitive emulsion layer a magenta-forming layer, and the blue-sensitive emulsion layer a yellow-forming coupler. However, in some cases, different combinations may be employed.

The photographic light-sensitive material of the present invention contains in its photographic emulsion layers color-forming couplers capable of forming color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, cyanoacetylcoumarone couplers, open chain acylacetonitrile couplers, etc., yellow couplers include acylacetamide couplers (e.g., benzoylacetanilides, pivaloylacetanilides, etc.), etc., and cyan couplers include naphthol couplers and phenol couplers. Of these couplers, nondiffusible couplers having a hydrophobic group called ballast group or polymerized couplers are desirable. The couplers may be of either 4-equivalent type or 2-equivalent type based on silver ion. Colored couplers having color-correcting effect, or couplers capable of releasing a development inhibitor or a development accelerator upon development (called DIR couplers or DAR couplers, respectively) may also be incorporated.

In addition to the DIR couplers, non-color-forming DIR coupling compounds capable of forming a colorless coupling reaction product and releasing a development inhibitor may also be incorporated.

Compounds capable of releasing a development inhibitor upon development may be incorporated in the light-sensitive material in addition to the DIR couplers.

The above-described couplers and the like may be used in combination of two or more in one and the same layer, or one and the same compound may be incorporated in two or more different layers for the purpose of obtaining the characteristic properties required for a particular light-sensitive material.

The photographic color couplers to be used are conveniently selected so as to obtain intermediate scale images. Maximum absorption band of a cyan dye formed from the cyan coupler preferably lies between about 600 and about 720 nm, maximum absorption band of a magenta dye formed from the magenta coupler lies between about 500 and about 580 nm, and maximum absorption band of a yellow dye formed from the yellow coupler lies between about 400 and about 480 nm.

Where dyes or UV ray abosrbents are incorporated in hydrophilic colloidal layers of the light-sensitive material prepared according to the present invention, they may be mordanted with cationic polymers or the like.

The light-sensitive material prepared according to the present invention may contain, as a color fog-preventing agent, a hydroquinone derivative, an aminophenol derivative, a gallic acid derivative, an ascorbic acid derivative, etc.

The light-sensitive material prepared according to the present invention may contain in its hydrophilic colloidal layer a UV ray absorbent. For example, arylsubstituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds [e.g., those described in Japanese Patent Application (OPI) No. 2784/71 (corresponding to U.S. Pat. No. 3,785,827)], cinnamic esters (e.g., those described in U.S. Pat. Nos. 3,705,805 and 3,707,375), butadiene compounds (e.g., those described in U.S. Pat. No. 4,045,229), or benzoxydol compounds (e.g., those described in U.S. Pat. No. 3,700,455) can be used. In addition, those described in U.S. Pat. No. 3,499,762 and Japanese Patent Application (OPI) No. 48535/79 can be used. UV ray-absorbing couplers (e.g., α-naphtholic cyan couplers) and UV ray-absorbing polymers may also be used. These UV ray absorbents may be mordanted to specific layers.

The light-sensitive material prepared according to the present invention may contain in its hydrophilic layers a water-soluble dye as a filter dye or for various purposes such as prevention of irradiation. Such dyes include oxonol dyes, hemioxonol dyes, styryl dyes, merocyanine dyes, cyanine dyes, and azo dyes. Of these, oxonol dyes, hemioxonol dyes, and merocyanine dyes are particularly useful.

In the practice of the present invention, the following known fading-preventing agents can be used in combination. The color image-stabilizing agents to be used in the present invention may be used alone or in combination of two or more. The known fading-preventing agents include, for example, hydroquinone derivatives, gallic acid derivatives, p-alkoxyphenols, p-hydroxyphenols, bisphenols and the like.

As a photographic support, those which are usually employed for photographic light-sensitive materials may be used such as cellulose nitrate film, cellulose acetate film, cellulose acetate butyrate film, cellulose acetate propionate film, polystyrene fulm, polyethylene terephthalate film, polycarbonate film, laminates of these films, paper (e.g., baryta paper, papers coated or laminated with α-olefin polymer such as polyethylene, etc.), and the like.

Opaque supports include essentially opaque ones such as paper, that which are prepared by adding a dye or a pigment such as titanium oxide to a transparent film, a plastic film having been surface-treated according to the method described in Japanese Patent Publication No. 19068/72, paper or plastic film to which carbon black, a dye, etc., has been added to make it completely light-shielding, and the like. A subbing layer adhesive to both the support and the photographic emulsion layer is usually provided.

The surface of the support may be subjected to a preliminary treatment such as a corona discharge treatment, UV ray irradiation, or flame treatment.

As the silver halide photographic light-sensitive material of the present invention, there are illustrated color negative-working light-sensitive materials for photographing use, color reversal light-sensitive materials (containing or not containing couplers), color paper light-sensitive materials, color positive-working films, etc.

In photographic processing of the layers composed of the photographic emulsion of the present invention, any of known processes and known processing solutions described in, for example, *Research Disclosure,* 176, 28–30 may be employed. Such processing may be a black-and-white photographic processing for forming a silver image (black-and-white processing) or a color photographic processing for forming a dye image (color photographic processing) depending upon the purpose. Processing temperature is usually selected between 18° and 50° C. However, temperatures lower than 18° C. or higher than 50° C. may be employed.

As a special type development processing, a developing agent may be incorporated in a light-sensitive material, for example, in an emulsion layer, the resulting light-sensitive material being processed in an alkaline aqueous solution to develop. Of the developing agents, hydrophobic ones can be incorporated in an emulsion according to various techniques described in *Research Disclosure,* 169, 16928, U.S. Pat. No. 3,739,890, British Pat. No. 813,253, West German Pat. No. 1,547,763, etc. Such development processing may be combined with a processing of stabilizing silver salt with a thiocyanate.

As a fixing solution, those which have the same formulation as are ordinarily employed can be used. As a fixing agent, organic sulfur compounds which are known to function as fixing agents can be used as well as thiosulfates and thiocyanates. The fixing solution may contain a water-soluble aluminum salt as a hardener.

In forming dye images, ordinary processes can be applied. For example, there may be employed a negative-positive process (described in, for example, *Journal of the Society of Motion Picture and Television Engineers,* Vol. 61 (1953), pp. 667 to 701.

Color developers generally comprise an alkaline aqueous solution containing a color developing agent. As the color developing agent, known primary aromatic amine developing agents may be used such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition, those described in L. F. A. Mason, *Photographic Processing Chemistry* (Focal Press, 1966), pp, 226–229, U.S. Pat. Nos. 2,193,015 and 2,592,364, Japanese Patent Application (OPI) No. 64933/73, etc., can be used.

The color developer may further contain a pH buffer (e.g., alkali metal sulfite, carbonate, borate or phosphate), a development inhibitor or antifoggant (e.g., bromide, iodide, organic antifoggant, etc.), etc. If necessary, it may contain a water softener, a preservative (e.g., hydroxylamine), an organic solvent (e.g., benzyl alcohol, diethylene glycol, etc.), a development accelerator (e.g., polyethylene glycol, quaternary ammonium salt, amine, etc.), a dye-forming coupler, a competitive coupler, a fogging agent (e.g., sodium borohydride), an auxiliary developing agent (e.g., 1-phenyl-3-pyrazolidone), a viscosity-imparting agent, a polycarboxylic acid type chelating agent, an antioxidant, etc.

Specific examples of these additives are described in U.S. Pat. No. 4,083,723, West German Patent Application (OLS) No. 2,622,950, etc., as well as *Research Disclosure,* 176, 17643.

Color developed photographic emulsion layers are usually bleached. Bleaching may be conducted separately or simultaneously with fixing. As bleaching agents, compounds of polyvalent metals such as iron (III), cobalt (III), chromium (VI), copper (II), etc., peracids, quinones, nitroso compounds, etc., are used.

For example, ferricyanates, dichromates, organic acid complex salts of iron (III) or cobalt (III) [e.g., complex salts of organic acids such as aminopolycarboxylic acids (e.g., ethylenediaminetetraacetic acid, nitrilotriacetic acid, 1,3-diamino-2-propanoltetraacetic acid, etc.), citric acid, tartaric acid, malic acid, etc.], persulfates, permanganates, nitrosophenol, etc., can be used. Of these, potassium ferricyanate, iron (III) sodium ethylenediaminetetraacetate, and iron (III) ammonium ethylenediaminetetraacetate are particularly useful. Iron (III) ethylenediaminetetraacetate is useful in both an independent bleaching solution and a monobath bleach-fixing solution.

To the bleaching or bleach-fixing solution may further be added bleaching-accelerating agents described in U.S. Pat. Nos. 3,042,520 and 3,241,966, Japanese Patent Publication Nos. 8506/70 (corresponding to U.S. Pat. No. 3,617,283) and 8836/70 (corresponding to U.S. Pat. No. 3,578,454), etc., thiol compounds described in Japanese Patent Application (OPI) No. 65732/78, and other various additives.

The present invention is now described in more detail by reference to the following examples which, however, are not to be construed as limiting the present invention in any way.

EXAMPLE 1

A multilayer, multicolor light-sensitive material (Sample 101) comprising a cellulose acetate film support having provided thereon layers of the following formulations was prepared. The amounts of coated emulsions are presented as the amounts of coated silver.

SAMPLE 101

1st Layer: Antihalation Layer

A gelatin layer containing:

| | |
|---|---|
| Black colloidal silver | 0.18 g/m$^2$ |
| UV ray absorbent C-1 | 0.12 g/m$^2$ |
| UV ray absorbent C-2 | 0.17 g/m$^2$ |

2nd Layer: Interlayer

A gelatin layer containing:

| | |
|---|---|
| 2,5-Di-t-pentadecylhydroquinone | 0.18 g/m$^2$ |
| Coupler C-3 | 0.11 g/m$^2$ |
| AgBrI emulsion (AgI: 1 mol %; average grain size: 0.07μ) | 0.15 g/m$^2$ |

3rd Layer: First Red-Sensitive Emulsion Layer

A gelatin layer containing:

| | |
|---|---|
| AgBrI emulsion (AgI: 6 mol %; average grain size: 0.6μ) | 0.72 g/m$^2$ |
| Sensitizing Dye I | $7.0 \times 10^{-5}$ mol/mol Ag |
| Sensitizing Dye II | $2.0 \times 10^{-5}$ mol/mol Ag |
| Sensitizing Dye III | $2.8 \times 10^{-4}$ mol/mol Ag |
| Sensitizing Dye IV | $2.0 \times 10^{-5}$ mol/mol Ag |
| Coupler C-4 | 0.093 g/m$^2$ |
| Coupler C-5 | 0.31 g/m$^2$ |
| Coupler C-6 | 0.010 g/m$^2$ |

4th Layer: Second Red-Sensitive Emulsion Layer

A gelatin layer containing:

| | |
|---|---|
| AgBrI emulsion (AgI: 10 mol %; average grain size: 1.5μ) | 1.2 g/m$^2$ |
| Sensitizing Dye I | $5.2 \times 10^{-5}$ mol/mol Ag |
| Sensitizing Dye II | $1.5 \times 10^{-5}$ mol/mol Ag |
| Sensitizing Dye III | $2.1 \times 10^{-4}$ mol/mol Ag |
| Sensitizing Dye IV | $1.5 \times 10^{-5}$ mol/mol Ag |
| Coupler C-4 | 0.10 g/m$^2$ |
| Coupler C-5 | 0.061 g/m$^2$ |
| Coupler C-7 | 0.046 g/m$^2$ |

5th Layer: Third Red-Sensitive Emulsion Layer

A gelatin layer containing:

| | |
|---|---|
| AgBrI emulsion (AgI: 10 mol %; average grain size: 2.2μ) | 2.0 g/m$^2$ |
| Sensitizing Dye I | $5.5 \times 10^{-5}$ mol/mol Ag |
| Sensitizing Dye II | $1.6 \times 10^{-5}$ mol/mol Ag |
| Sensitizing Dye III | $2.2 \times 10^{-5}$ mol/mol Ag |
| Sensitizing Dye IV | $1.6 \times 10^{-5}$ mol/mol Ag |
| Coupler C-5 | 0.044 g/m$^2$ |
| Coupler C-7 | 0.16 g/m$^2$ |

6th Layer: Interlayer

A gelatin layer

7th Layer: First Green-Sensitive Emulsion Layer

| | |
|---|---|
| AgBrI emulsion (AgI: 5 mol %; average grain size: 0.5μ) | 0.55 g/m$^2$ |
| Sensitizing Dye V | $3.8 \times 10^{-4}$ mol/mol Ag |
| Sensitizing Dye VI | $3.0 \times 10^{-5}$ mol/mol Ag |
| Sensitizing Dye VII | $1.2 \times 10^{-4}$ mol/mol Ag |
| Coupler C-8 | 0.29 g/m$^2$ |
| Coupler C-9 | 0.040 g/m$^2$ |
| Coupler C-10 | 0.055 g/m$^2$ |
| Coupler C-11 | 0.058 g/m$^2$ |

8th Layer: Second Green-Sensitive Emulsion Layer

A gelatin layer containing:

| | |
|---|---|
| AgBrI emulsion (AgI: 6 mol %; average grain size: 1.5μ) | 1.0 g/m$^2$ |
| Sensitizing Dye V | $2.7 \times 10^{-4}$ mol/mol Ag |
| Sensitizing Dye VI | $2.1 \times 10^{-5}$ mol/mol Ag |
| Sensitizing Dye VII | $8.5 \times 10^{-5}$ mol/mol Ag |
| Coupler C-8 | 0.25 g/m$^2$ |
| Coupler C-9 | 0.013 g/m$^2$ |
| Coupler C-10 | 0.009 g/m$^2$ |
| Coupler C-11 | 0.011 g/m$^2$ |

9th Layer: Third Green-Sensitive Emulsion Layer

A gelatin layer containing:

| | |
|---|---|
| AgBrI emulsion (AgI: 10 mol %; average grain size: 2.2μ) | 1.2 g/m$^2$ |
| Sensitizing Dye V | $3.0 \times 10^{-4}$ mol/mol Ag |
| Sensitizing Dye VI | $2.4 \times 10^{-5}$ mol/mol Ag |
| Sensitizing Dye VII | $9.5 \times 10^{-5}$ mol/mol Ag |
| Coupler C-12 | 0.070 g/m$^2$ |
| Coupler C-9 | 0.013 g/m$^2$ |

10th Layer: Yellow Filter Layer

A gelatin layer containing:

| | |
|---|---|
| Yellow colloidal silver | 0.04 g/m$^2$ |
| 2,5-Di-t-pentadecylhydroquinone | 0.031 g/m$^2$ |

11th Layer: First Blue-Sensitive Emulsion Layer

A gelatin layer containing:

| | |
|---|---|
| AgBrI emulsion (AgI: 6 mol %; average grain size: 0.4μ) | 0.32 g/m$^2$ |
| Coupler C-13 | 0.68 g/m$^2$ |
| Coupler C-14 | 0.030 g/m$^2$ |

12th Layer: Second Blue-Sensitive Emulsion Layer

A gelatin layer containing:

| | |
|---|---|
| AgBrI emulsion (AgI: 10 mol %; average grain size: 1.0μ) | 0.29 g/m$^2$ |
| Coupler C-13 | 0.22 g/m$^2$ |
| Sensitizing Dye VIII | $2.2 \times 10^{-4}$ mol/mol Ag |

13th Layer: Fine-Grain Emulsion Layer

A gelatin layer containing:

| | |
|---|---|
| AgBrI emulsion (AgI: 2 mol %; average grain size: 0.15 μ) | 0.40 g/m$^2$ |

14th Layer: Third Blue-Sensitive Emulsion Layer

A gelatin layer containing:

| | |
|---|---|
| AgBrI emulsion (AgI: 14 mol %; average grain size: 2.3μ) | 0.79 g/m$^2$ |
| Coupler C-13 | 0.19 g/m$^2$ |
| Coupler C-15 | 0.001 g/m$^2$ |
| Sensitizing Dye VIII | $2.3 \times 10^4$ mol/mol Ag |

15th Layer: First Protective Layer

A gelatin layer containing:

| | |
|---|---|
| UV Ray Absorbent C-1 | 0.14 g/m$^2$ |
| UV Ray Absorbent C-2 | 0.22 g/m$^2$ |

16th Layer: Second Protective Layer

A gelatin layer containing:

| | |
|---|---|
| Polymethyl methacrylate particles (diameter: 1.5μ) | 0.05 g/m$^2$ |

Each layer described above contained 4-hydroxy-6-methyltetraazaindene, Gelatin Hardener C-16, and a surfactant in addition to the above-described formulations.

Compound C-1

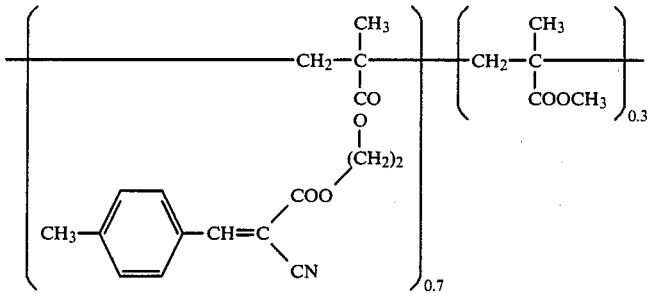

(molecular weight: about 20,000)

C-2

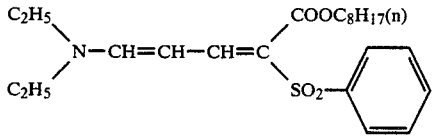

C-3

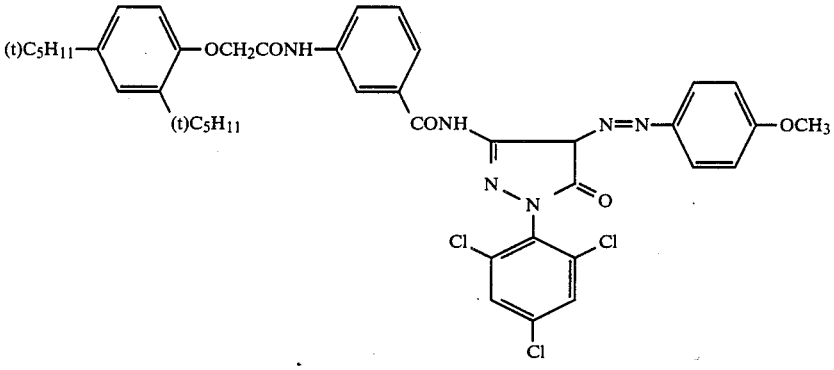

C-4

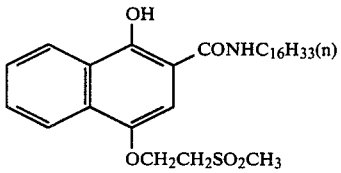

C-5

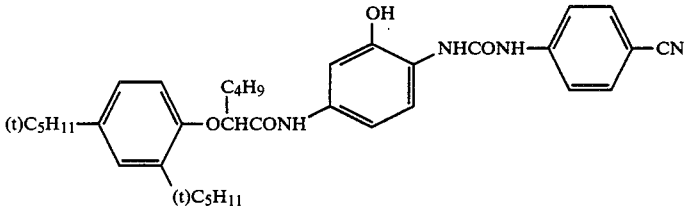

C-6

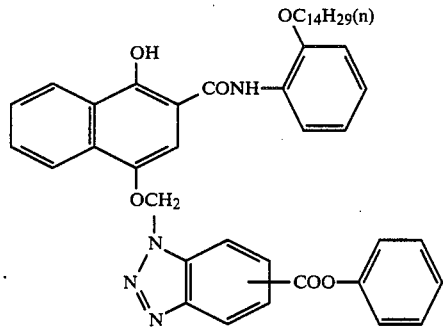

C-7

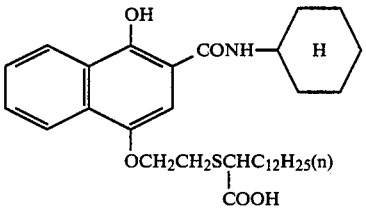

-continued
C-8
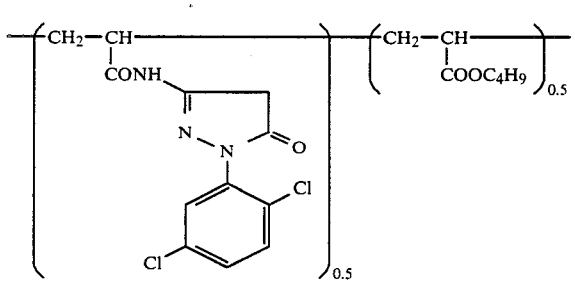
(molecular weight: about 20,000)
C-9
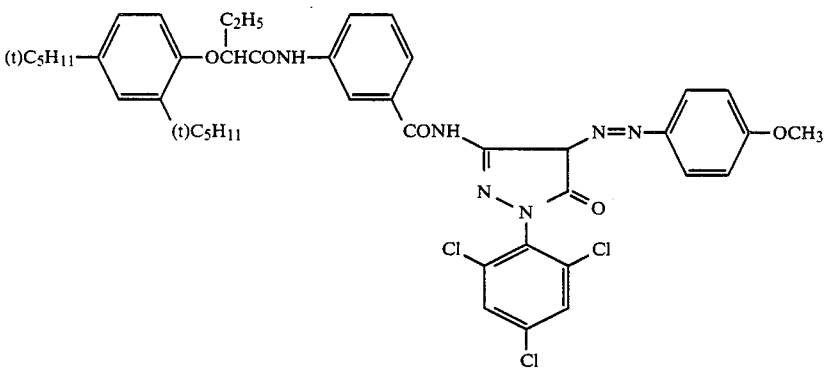
C-10
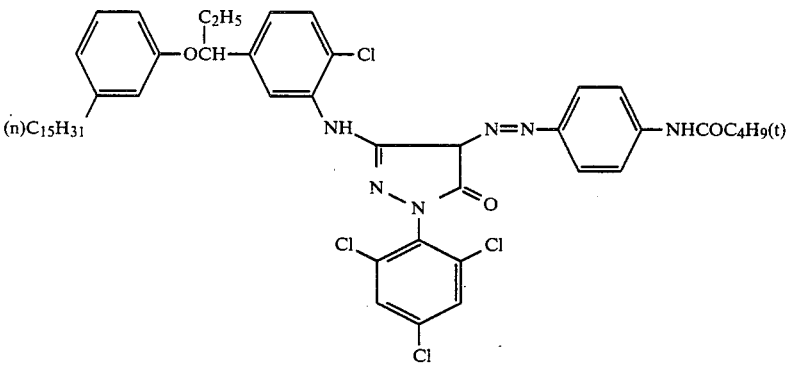
C-11
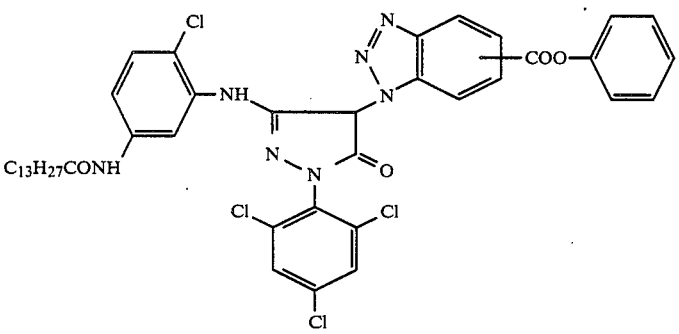

-continued
C-12
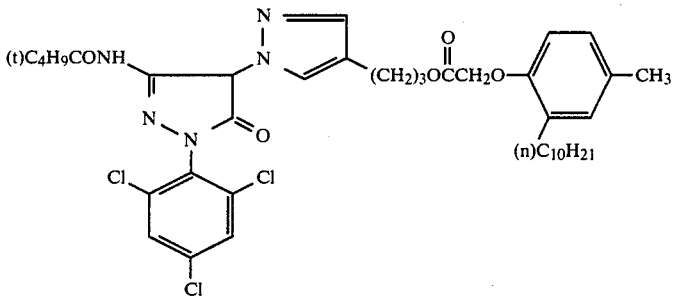
C-13
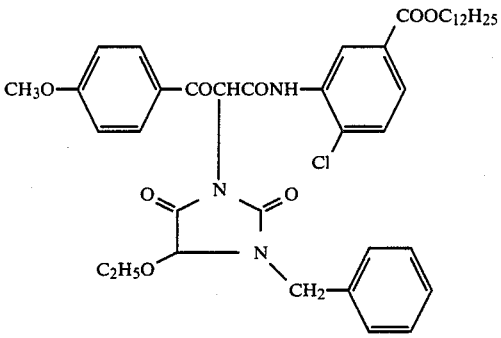
C-14
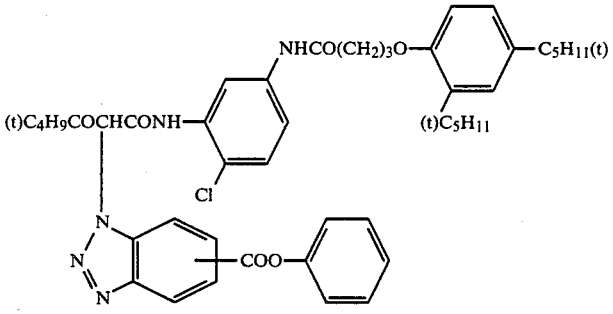
C-15
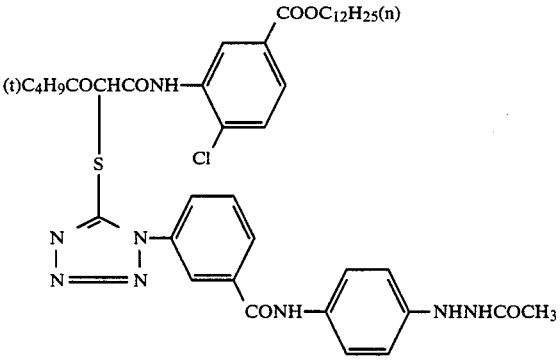
C-16
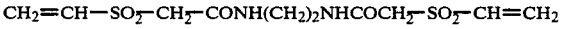
Sensitizing Dye I
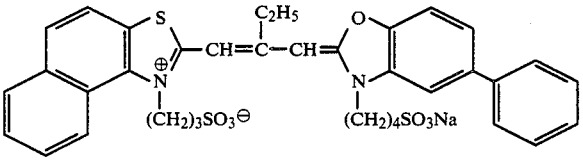
II
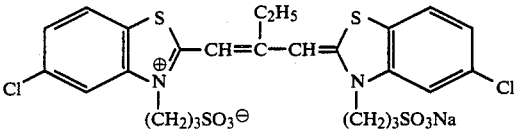
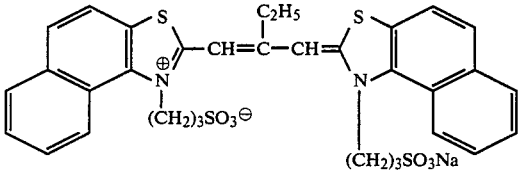
III
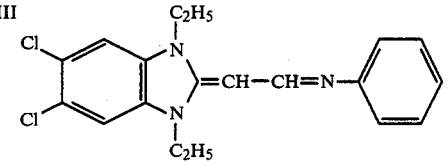
IV
V
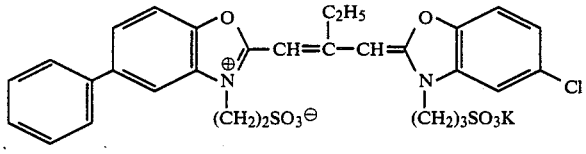

-continued

VI

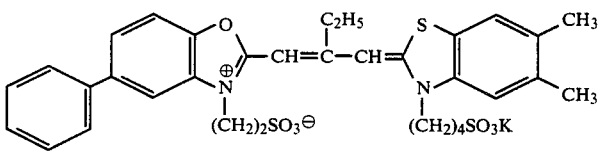

VII

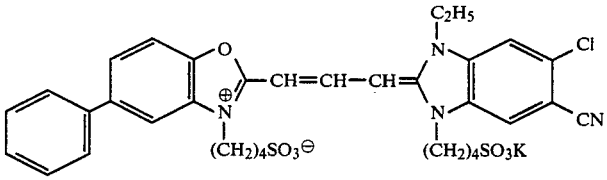

VIII

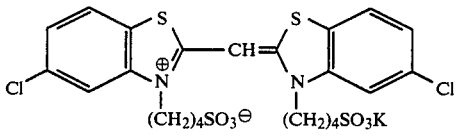

Samples 102 to 105 were prepared as follows.

SAMPLE 102

Sample 102 was prepared in the same manner as Sample 101 except for adding a methanol solution of Compound (1) of the present invention to the 5th layer, 9th layer, and 14th layer of Sample 101 in coating amounts of $5\times10^{-4}$ g/m$^2$, $3\times10^{-4}$ g/m$^2$, and $2\times10^{-4}$ g/m$^2$, respectively.

SAMPLE 103

Sample 103 was prepared in the same manner as Sample 102 except for adding the silver bromoiodide emulsion of 0.07$\mu$ in average grain size containing 2 mol% silver iodide to the 16th layer of Sample 102 in an amount of 0.3 g of silver/m$^2$.

SAMPLE 104

Sample 104 was prepared in the same manner as Sample 101 except for adding the silver bromoiodide emulsion of 0.07$\mu$ in average grain size containing 2 mol% silver iodide to the 16th layer of Sample 101 in an amount of 0.3 g/m$^2$.

SAMPLE 105

Sample 105 was prepared in the same manner as Sample 101 except for adding 2,4-dichloro-6-hydroxytriazine (C-17) in place of C-16 in a sufficient amount to attain the same swelling of the coat.

Tests on Fogging and Preservability

After leaving the thus prepared samples until the coats were fully hardened, a pair of each sample were exposed for sensitometry, one having been stored for 3 days in an atmosphere of 60° C. and 30% RH, and the other having been stored for 3 days in an atmosphere of 25° C. and 60% RH before the exposure. Then, they were developed with the following processing solutions, followed by conducting sensitometry. The results thus obtained are shown in Table 1.

With Samples 101 to 104, swelling of the coats became constant 5 days after coating and, with Sample 105, swelling of the coats became constant 21 days after coating.

| | |
|---|---|
| 1. Color Development | 3 min & 15 sec |
| 2. Bleaching | 6 min & 30 sec |
| 3. Washing with Water | 3 min & 15 sec |
| 4. Fixing | 6 min & 30 sec |
| 5. Washing | 3 min & 15 sec |
| 6. Stabilizing | 3 min & 15 sec |

The processing solutions used in the above-described steps had the following formulations.

| Color Developer: | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—$\beta$-hydroxyethylamino)-2-methylaniline Sulfate | 4.5 g |
| Water to make | 1 liter |

| Bleaching Solution: | |
|---|---|
| Ammonium Bromide | 160.0 g |
| Aqueous Ammonia (28%) | 25.0 ml |
| Sodium Iron Ethylenediaminetetraacetate | 130 g |
| Glacial Acetic Acid | 14 ml |
| Water to make | 1 liter |

| Fixing Solution: | |
|---|---|
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 liter |

| Stabilizing Solution: | |
|---|---|
| Formalin | 8.0 ml |
| Water to make | 1 liter |

TABLE 1

| | | | | Photographic Properties | | |
|---|---|---|---|---|---|---|
| | | | | After 3 Days at 25° C., 60% RH | | After 3 Days at 60° C., 30% RH |
| Sample No. | Fing Grain Emulsion in Protective Layer | Compound of Invention | Hardener | Fog | Relative Sensitivity | Fog |
| 101 | — | — | C-16 B | ±0 | 100 | +0.17 |

TABLE 1-continued

| Sample No. | Fing Grain Emulsion in Protective Layer | Compound of Invention | Hardener | | Photographic Properties: After 3 Days at 25° C., 60% RH Fog | Relative Sensitivity | After 3 Days at 60° C., 30% RH Fog |
|---|---|---|---|---|---|---|---|
| | | | | G | ±0 | 100 | +0.15 |
| | | | | R | ±0 | 100 | +0.20 |
| 102 | — | (1) | C-16 | B | −0.02 | 102 | +0.05 |
| | | | | G | −0.30 | 100 | +0.04 |
| | | | | R | −0.02 | 105 | +0.08 |
| 103 | Used | (1) | C-16 | B | +0.03 | 135 | +0.08 |
| (present | | | | G | −0.03 | 102 | +0.05 |
| invention) | | | | R | −0.02 | 104 | +0.08 |
| 104 | Used | — | C-16 | B | +0.06 | 128 | +0.25 |
| | | | | G | −0.03 | 101 | +0.15 |
| | | | | R | −0.02 | 103 | +0.20 |
| 105 | — | — | C-17 | B | −0.01 | 101 | +0.12 |
| | | | | G | ±0 | 99 | +0.10 |
| | | | | R | ±0 | 98 | +0.15 |

In Table 1, the fog values of samples which had been stored for 3 days at 25° C. and 60% RH were presented as relative values taking the fog value of Sample 101 as ±0. The relative sensitivities were presented as relative values taking the sensitivity of Sample 101 as 100. The fog values of samples stored for 3 days at 60° C. and 30% RH were presented as relative values taking that of corresponding samples which had been stored for 3 days at 25° C. and 60% RH as ±0.

Processability Test

Each of Sample 102, Sample 103, and commercially available film VR-100 (color negative-working film made by Eastman Kodak Company) was subjected to running tests under the following conditions to prepare Fatigued Developers R-1, R-2 and R-3.

The three running solutions were used to conduct sensitometry of Samples 101 to 104, and sensitivities of blue-sensitive layers most susceptible to the influence of fatigued developer, obtained by the sensitometry, are tabulated in Table 2.

That is, the development processing comprising the aforesaid processing steps was initiated using 2 liter portions of the parent liquors of the following formulations and, every time after processing 350 $cm^2$ of the color negative-working films, 50 ml portions of replenishment solutions of the following formulations were added, thus 1 $m^2$ of the films being processed to prepare R-1 to R-3.

| Color Developer: | Mother Liquor | Replenishment Solution |
|---|---|---|
| Sodium Nitrilotriacetate | 1.0 g | 1.1 g |
| Sodium Sulfite | 4.0 g | 4.4 g |
| Sodium Carbonate | 30.0 g | 32.0 g |
| Potassium Bromide | 1.4 g | 0.7 g |
| Hydroxylamine Sulfate | 2.4 g | 2.6 g |
| 4-(N—Ethyl-N—β-hydroxyethylamino)-2-methylaniline Sulfate | 4.5 g | 5.0 g |
| Water to make | 1 l | 1 l |

| Bleaching Solution: | Mother Liquor | Replenishment Solution |
|---|---|---|
| Ammonium Bromide | 160.0 g | 176.0 g |
| Aqueous Ammonia (28%) | 25.0 ml | 15.0 ml |

-continued

| Bleaching Solution: | Mother Liquor | Replenishment Solution |
|---|---|---|
| Sodium Iron Ethylenediaminetetraacetate | 130.0 g | 143.0 g |
| Glacial Acetic Acid | 14.0 ml | 14.0 ml |
| Water to make | 1 l | 1 l |

| Fixing Solution: | Mother Liquor | Replenishment Solution |
|---|---|---|
| Sodium Tetrapolyphosphate | 2.0 g | 2.2 g |
| Sodium Sulfite | 4.0 g | 4.4 g |
| Ammonium Thiosulfate (70%) | 175.0 ml | 193.0 ml |
| Sodium Bisulfite | 4.6 g | 5.1 g |
| Water to make | 1 l | 1 l |

| Stabilizing Solution: | Mother Liquor | Replenishment Solution |
|---|---|---|
| Rormalin | 8.0 ml | 9.0 ml |
| Water to make | 1 l | 1 l |

In Table 2, the relative sensitivities are presented as relative values taking the sensitivity of Sample 101 obtained by using the developer as 100.

TABLE 2

| Sample No. | Relative Sensitivity: Developer | R-1 | R-2 | R-3 |
|---|---|---|---|---|
| 101* | 100 | 85 | 98 | 78 |
| 102* | 102 | 75 | 93 | 69 |
| 103** | 135 | 130 | 134 | 128 |
| 104* | 128 | 123 | 126 | 121 |

*Comparative sample
**Sample of the present invention

As is clear from Tables 1 and 2, Sample 103 containing the fine grain silver halide emulsion and the compound (1) of the present invention can depress an increased fog of the unexposed light-sensitive material after preservation which is caused by the use of a fine grain emulsion in a protective layer, difficulty causes reduction of developer power due to the dissolution of development inhibitor into the developer even when processed using a running developer, and is less dependent on the developer as to photographic properties.

EXAMPLE 2

Samples 201, 202, 203, 204 and 205 were prepared in the same manner as Sample 103 except for using, in place of Compound (1) of the present invention, Compound (2), (3), (6), Comparative Compound A (p-hydroxyphenylmercaptotetrazole) or Comparative Compound B (p-carboxyphenyl-2-mercaptoimidazole) in an equimolar amount, and subjected to the same preservability test as in Example 1. The results thus obtained are shown in Table 3.

In Table 3, the fog values of samples stored for 3 days at 25° C. and 60% RH were presented as relative values taking the fog value of Sample 104 as ±0. The relative sensitivities were presented as relative values taking the sensitivity of Sample 104 as 100. The fog values of samples stored for 3 days at 60° C. and 30% RH were presented as relative values taking that of corresponding samples stored for 3 days at 25° C. and 60% RH as ±0.

TABLE 3

| | | | Photographic Properties | | |
|---|---|---|---|---|---|
| | | | After 3 Days at 25° C., 60% RH | | After 3 Days at 60° C., 30% RH |
| Sample No. | Compound | | Fog | Relative Sensitivity | Fog |
| 104 | — | B | ±0.00 | 100 | +0.25 |
| | | G | ±0.00 | 100 | +0.15 |
| | | R | ±0.00 | 100 | +0.20 |
| 201 | (2) | B | −0.02 | 104 | +0.07 |
| (present | | G | −0.03 | 100 | +0.05 |
| invention) | | R | −0.02 | 100 | +0.09 |
| 202 | (3) | B | −0.02 | 103 | +0.08 |
| (present | | G | −0.03 | 98 | +0.06 |
| invention) | | R | −0.03 | 100 | +0.09 |
| 203 | (4) | B | −0.01 | 101 | +0.12 |
| (present | | G | −0.02 | 97 | +0.08 |
| invention) | | R | −0.02 | 100 | +0.13 |
| 204 | A | B | −0.02 | 75 | +0.06 |
| | | G | −0.03 | 68 | +0.10 |
| | | R | −0.02 | 83 | +0.13 |
| 205 | B | B | −0.02 | 68 | +0.07 |
| | | G | −0.01 | 63 | +0.09 |
| | | R | −0.01 | 75 | +0.12 |

As is clear from Table 3, Samples 201, 202 and 203 using the compounds of the present invention can remarkably depress fog of unexposed light-sensitive materials after preservation without reduction of sensitivity.

However, Samples 204 and 205 using Compounds A and B outside the scope of the compounds of the present invention seriously reduce sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon light-sensitive silver halide emulsion layers, wherein on the outside of the light-sensitive silver halide emulsion layer positioned farthest from the support, a protective emulsion layer containing silver halide fine grains of 0.2μ or less in average grain size which are not substantially developable by development processing of the silver halide color photographic light-sensitive material and which are less sensitive than the light sensitive silver halide grains in said light sensitive silver halide emulsion layers by 0.5 or more in terms of log units is provided, and in the silver halide color photographic light-sensitive material at least one compound represented by the following general formula (I) is present in an amount sufficient to depress fog of the silver halide color photographic material after preservation:

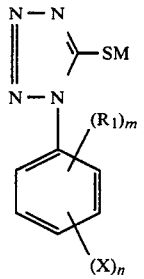

(I)

wherein M represents a hydrogen atom, an alkali metal or a quaternary ammonium group, X represents COOM′ or $SO_3M'$, wherein M′ represents a hydrogen atom, an alkali metal or a quaternary ammonium group, n represents 1 or 2, $R_1$ represents a group capable of substituting on the phenyl group, and m represents 0, 1 or 2.

2. The silver halide color photographic light-sensitive material as claimed in claim 1, wherein said alkali metal is selected from the group consisting of potassium, sodium and lithium and said quaternary ammonium group is selected from the group consisting of $-\overset{\oplus}{N}H_4$, $-\overset{\oplus}{N}(CH_3)_4$, $-\overset{\oplus}{N}(C_2H_5)_4$, and $-\overset{\oplus}{N}H(C_2H_5)_3$.

3. The silver halide color photographic light-sensitive material as claimed in claim 1, wherein X represents COOM′ wherein M′ represents a hydrogen atom, an alkali metal or a quaternary ammonium group.

4. The silver halide color photographic light-sensitive material as claimed in claim 1, wherein $R_1$ is selected from the group consisting of a halogen atom, an alkyl group, an aryl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, a hydroxy group, and an amino group.

5. The silver halide color photographic light-sensitive material as claimed in claim 1, wherein said $R_1$ is selected from the group consisting of an alkyl group, a substituted alkyl group, an alkoxy group, and a substituted alkoxy group, each having up to 3 carbon atoms.

6. The silver halide color photographic light-sensitive material as claimed in claim 1, wherein said compound represented by formula (I) is employed in an amount of from about $10^{-4}$ to about $10^{-1}$ mol per mol of silver.

7. The silver halide color photographic light-sensitive material as claimed in claim 6, wherein said compound represented by formula (I) is employed in an amount of from $10^{-3}$ to $5\times10^{-2}$ per mol of silver.

8. The silver halide color photographic light-sensitive material as claimed in claim 1, wherein the compound represented by general formula (I) is added to a light-sensitive emulsion layer, a protective layer or an interlayer.

9. The silver halide color photographic light-sensitive material as claimed in claim 1, wherein said compound represented by general formula (I) is incorporated in a layer positioned closer to the support than the protective layer which contains fine silver halide grains.

10. The silver halide color photographic light-sensitive material as claimed in claim 1, wherein said silver halide fine grains have an average grain size of 0.15 μm or less.

11. The silver halide color photographic light-sensitive material as claimed in claim 10, wherein said silver halide fine grains have an average grain size of 0.1 μm or less.

12. The silver halide color photographic light-sensitive material as claimed in claim 1, wherein said silver halide fine grains are coated in an amount of from 0.03 to 2.0 g of silver/$m^2$.

13. The silver halide color photographic light-sensitive material as claimed in claim 12, wherein said silver halide fine grains are coated in an amount of from 0.05 to 1 g of silver/$m^2$.

14. The silver halide color photographic light-sensitive material as claimed in claim 1, wherein said silver halide fine grains are less sensitive than light-sensitive silver halide grains in said light-sensitive silver halide emulsion layers by 1.0 or more in terms of log units.

15. The silver halide color photographic light-sensitive material as claimed in claim 1, wherein said light-sensitive material contains a hardener represented by the following general formula (II):

$$(CH_2{=}CH{-}SO_2{-}CH_2)_2A$$

wherein A represents a divalent group which may or may not be present.

* * * * *